US007507269B2

(12) United States Patent
Murphy et al.

(10) Patent No.: US 7,507,269 B2
(45) Date of Patent: Mar. 24, 2009

(54) BAGLESS STICK TYPE VACUUM CLEANER

(75) Inventors: John S. Murphy, Brookpark, OH (US); David Khalil, Highland Heights, OH (US); Michael F. Wright, Stow, OH (US); Robert A. Matousek, Lakewood, OH (US); Yung Leong Hin, Hong Kong (HK)

(73) Assignee: Royal Appliance Mfg. Co., Glenwillow, OH (US)

( * ) Notice: Subject to any disclaimer, the term of this patent is extended or adjusted under 35 U.S.C. 154(b) by 0 days.

(21) Appl. No.: 11/356,571

(22) Filed: Feb. 17, 2006

(65) Prior Publication Data

US 2006/0162118 A1 Jul. 27, 2006

Related U.S. Application Data

(63) Continuation of application No. 10/339,829, filed on Jan. 10, 2003.

(51) Int. Cl.
*B01D 47/02* (2006.01)
*A47L 9/16* (2006.01)
*A47L 9/24* (2006.01)

(52) U.S. Cl. ..... 55/337; 55/429; 55/459.1; 55/482; 55/DIG. 3; 15/327.1; 15/327.2; 15/327.6; 15/327.7; 15/347; 15/352; 15/353

(58) Field of Classification Search ..... 55/337, 55/429, 459.1, 482, DIG. 3, 357; 15/327.1, 15/327.2, 327.6, 327.7, 347, 350–353; 210/470, 210/471
See application file for complete search history.

(56) References Cited

U.S. PATENT DOCUMENTS 1,768,617 A 7/1930 Lee
2,260,222 A 10/1941 Hahn
2,564,339 A 8/1951 Nerheim
2,610,702 A 9/1952 Thornwald
RE23,604 E * 12/1952 Schultz ..... 210/458
2,822,201 A * 2/1958 Wood ..... 277/637
2,898,622 A 8/1959 Hurd
3,039,129 A 6/1962 Belicka et al.

(Continued)

FOREIGN PATENT DOCUMENTS

FR 1 468 142 2/1967

(Continued)

OTHER PUBLICATIONS

National Brochure concerning Model No. MC-110U dated Feb. 5, 1981.

*Primary Examiner*—Duane S Smith
*Assistant Examiner*—Minh-Chau T. Pham
(74) *Attorney, Agent, or Firm*—Fay Sharpe LLP

(57) ABSTRACT

An upright vacuum cleaner includes a nozzle base having a main suction opening formed in an underside thereof. A housing is hingedly connected to the nozzle base. The housing includes a dirt separation chamber and a dirt receptacle for receiving dirt and dust separated by the dirt separation chamber. A conduit connects the nozzle base to the housing. A suction source is located in one of the housing and the nozzle base. The suction source is in fluid communication with the dirt separation chamber. A generally conically shaped filter extends into the dirt separation chamber along a longitudinal axis of the dirt separation chamber.

22 Claims, 9 Drawing Sheets

U.S. PATENT DOCUMENTS 3,209,917 A * 10/1965 Yelinek ..... 210/484
3,704,482 A 12/1972 Brannon
4,172,710 A 10/1979 van der Molen
4,198,726 A 4/1980 Powell, Jr.
4,376,322 A 3/1983 Lockhart et al.
4,571,772 A 2/1986 Dyson
4,573,236 A 3/1986 Dyson
4,665,582 A 5/1987 Richmond et al.
4,686,736 A 8/1987 Petralia et al.
4,810,379 A * 3/1989 Barrington ..... 210/232
4,967,443 A 11/1990 Krasznai et al.
5,020,186 A 6/1991 Lessig, III et al.
5,107,567 A 4/1992 Ferrari et al.
5,145,499 A 9/1992 Dyson
5,248,323 A 9/1993 Stevenson
5,254,147 A 10/1993 Finke
5,287,591 A 2/1994 Rench et al.
5,388,303 A 2/1995 Hemmann et al.
5,446,943 A 9/1995 Sovis et al.
5,593,479 A 1/1997 Frey et al.
5,617,611 A 4/1997 Wörwag
5,659,922 A 8/1997 Louis
5,713,103 A 2/1998 Keebler et al.
5,732,439 A 3/1998 Cipolla
5,779,745 A 7/1998 Kilstrom
5,850,666 A 12/1998 Farone et al.
5,869,947 A 2/1999 Zahuranec
5,935,279 A 8/1999 Kilstrom
6,003,196 A 12/1999 Wright et al.
6,012,200 A 1/2000 Murphy et al.
6,026,540 A 2/2000 Wright et al.
6,070,291 A 6/2000 Bair et al.
6,079,077 A 6/2000 Kajihara et al.
6,146,434 A 11/2000 Scalfani et al.
6,260,234 B1 7/2001 Wright et al.
6,317,921 B1 11/2001 Park et al.
6,341,404 B1 1/2002 Salo et al.
6,353,963 B1 3/2002 Bair et al.
6,375,696 B2 4/2002 Wegelin et al.
6,401,295 B2 6/2002 Bair et al.
6,428,589 B1 8/2002 Bair et al.
6,436,160 B1 8/2002 Stephens et al.
6,482,252 B1 11/2002 Conrad et al.
6,558,453 B2 5/2003 Sepke et al.
6,565,637 B2 * 5/2003 Alberts et al. ..... 96/333
6,596,044 B1 7/2003 Bilek et al.
6,598,263 B2 * 7/2003 Boles et al. ..... 15/352
6,615,444 B2 * 9/2003 McGilll et al. ..... 15/352
6,647,587 B1 11/2003 Ohara et al.
6,709,495 B1 * 3/2004 Storer ..... 96/58
6,757,933 B2 7/2004 Oh et al.
D494,329 S 8/2004 Thur et al.
6,775,882 B2 * 8/2004 Murphy et al. ..... 15/352
6,793,811 B1 * 9/2004 Fleischmann ..... 210/163
6,829,804 B2 * 12/2004 Sepke ..... 15/347
D520,127 S 5/2006 Khalil
D521,137 S 5/2006 Khalil
7,132,045 B1 * 11/2006 Trangsrud ..... 210/163
7,166,141 B2 * 1/2007 Skinner Macleod et al. ... 55/337
D541,399 S 4/2007 Khalil
2002/0029436 A1 * 3/2002 Hawkins et al. ..... 15/339
2002/0095741 A1 7/2002 Inoue et al.
2002/0166199 A1 11/2002 Boles et al.
2003/0131441 A1 7/2003 Murphy et al.
2003/0182757 A1 * 10/2003 Sepke ..... 15/353
2004/0031121 A1 * 2/2004 Martin et al. ..... 15/246.2
2004/0034962 A1 * 2/2004 Thur et al. ..... 15/353
2004/0074041 A1 4/2004 Overvaag

FOREIGN PATENT DOCUMENTS

WO WO 99/30602 6/1999

* cited by examiner

BAGLESS STICK TYPE VACUUM CLEANER

This application is a continuation of U.S. application Ser. No. 10/339,829 which was filed on Jan. 10, 2003 and is still pending.

BACKGROUND OF THE INVENTION

The present invention relates to vacuum cleaners. More particularly, the present invention relates to stick type vacuum cleaners that employ a dust cup.

Upright vacuum cleaners are very well known in the art. One type of upright vacuum cleaner which has become common in the marketplace is a stick type vacuum cleaner in which a dust cup is employed for holding dirt and dust separated from an airstream. In most stick type vacuum cleaners, a nozzle base travels across a bare floor, carpet or other surface being cleaned. Pivotally mounted to a nozzle base is an upright housing portion. Often this is formed as a rigid plastic housing having a socket for accommodating the dust cup. As is well known, a suction source such as a motor and fan assembly is mounted to either the nozzle base or the upright housing of the vacuum cleaner.

It is now also known in the art of vacuum cleaners to use cyclonic action to separate particles from a stream of dirt laden air. To this end, the dirt laden air is directed tangentially into the dust cup and flows in a swirling motion in the dust cup. Dirt particles are flung outwardly toward the side wall of the dust cup while air is withdrawn along a longitudinal axis of the dust cup.

One known type of stick type vacuum cleaner employing a dust cup with cyclonic airflow utilizes an inverted truncated cone positioned within the dust cup. A baffle extends outwardly from an outer surface of the cone. The baffle cooperates with the cone for directing a stream of dirt laden air in a cyclonic manner about the outer surface wall of the cone. In order to remove dust from the dust laden airstream, a filter is positioned outside the dust cup and mounted thereto. This design is disadvantageous from the standpoint that two different elements are needed to provide the cyclonic airflow and to filter the dirt from the airstream. It would be beneficial to have a design wherein the filter element can be positioned in the dust cup rather than being forced out of the dust cup due to the presence of a structure for generating a cyclonic airflow within the dust cup.

Accordingly, it has been deemed desirable to develop a new and improved stick type vacuum cleaner which would overcome the foregoing difficulties and others while providing better and more advantageous overall results.

BRIEF SUMMARY OF THE INVENTION

In accordance with one aspect of the present invention, an upright vacuum cleaner is provided. More particularly, in accordance with this aspect of the invention, the vacuum cleaner comprises a nozzle base including a main suction opening formed on an underside thereof. An upright housing is hingedly connected to the nozzle base. The housing includes a dirt separation chamber and a dirt receptacle for receiving dirt and dust separated by the dirt separation chamber. A conduit connects the nozzle base to the housing. A suction source is located in one of the housing and the nozzle base and is in fluid communication with the dirt separation chamber. A generally conically shaped filter extends into the dirt separation chamber along a longitudinal axis of the dirt separation chamber.

According to another aspect of the present invention, a vacuum cleaner is provided. In connection with this aspect of the invention, the vacuum cleaner comprises a nozzle base and a housing pivotally mounted on the nozzle base. The housing defines a cyclonic airflow chamber for separating contaminants from a suction airstream. The housing further comprises an inlet for the cyclonic airflow chamber and an outlet for the cyclonic airflow chamber. A dirt container is selectively mounted in the housing and defines at least a portion of the cyclonic airflow chamber for receiving and retaining dirt and dust separated from the suction airstream in the cyclonic airflow chamber. An airstream suction source is mounted to one of the housing and the nozzle base. The suction source is in fluid communication with the cyclonic airflow chamber and has an inlet disposed downstream from the cyclonic airflow chamber outlet. A filter assembly is selectively mounted to the dirt container and extends into the dirt container. The filter assembly includes a longitudinal axis and a support member including a handle. The longitudinal axis passes through the handle.

According to still another aspect of the present invention, a vacuum cleaner comprises a first housing member comprising a cyclonic airflow chamber adapted for separating entrained dirt and dust from the circulating airstream. A dust cup is releasably mounted to the first housing member. The dust cup, which includes an open first end and a closed second end, holds dirt and dust separated from the cyclonic airflow chamber. A second housing member defines a main suction opening. A first conduit fluidly connects the main suction opening of the second housing member to an inlet of the cyclonic airflow chamber. A generally conically shaped filter assembly is selectively mounted to the dust cup. It extends along a longitudinal axis of the dust cup. An airstream source is mounted to the first housing member and is positioned above the cyclonic airflow chamber. The airstream source is adapted for generating and maintaining an airstream flowing through the cyclonic airflow chamber.

In accordance with a further aspect of the present invention, a vacuum cleaner comprises a nozzle section and a housing section connected to the nozzle section and in fluid communication with the nozzle section. A dust cup is selectively mounted to the housing section. The dust cup holds dirt and dust separated from a suction airstream flowing into the housing section. A suction source is in fluid communication with the dust cup. A cyclonic airflow chamber is defined at least partially in the dust cup for separating particulate material entrained in an airstream flowing from the nozzle section towards the suction source. A tapered filter assembly extends into the dust cup for further separating dirt and dust from the suction airstream.

In accordance with yet another aspect of the present invention, a vacuum cleaner comprises a housing in communication with a suction opening and including a socket. A dust cup is removably mounted in the housing socket. The dust cup comprises an open first end, a closed second end and a side wall. A filter is selectively mounted to the dust cup first end and extends into the dust cup. A particle separation chamber is defined in the dust cup between an interior wall of the dust cup and the filter for separating particles from an airstream flowing from the suction opening through an inlet located in the dust cup side wall. A suction source is in fluid communication with the dust cup first end. The suction source is located in the housing for generating and maintaining a suction airstream from the suction opening through the filter.

Still further benefits and advantages of the present invention will become apparent to those of average skill in the art from a review of the following detailed description of the present invention.

BRIEF DESCRIPTION OF THE DRAWINGS

The invention may take form in certain parts and arrangements of parts, preferred embodiments of which will be described in detail in this specification and illustrated in the accompanying drawings which form a part hereof and wherein.

DETAILED DESCRIPTION OF THE PREFERRED EMBODIMENTS

Figure 1:
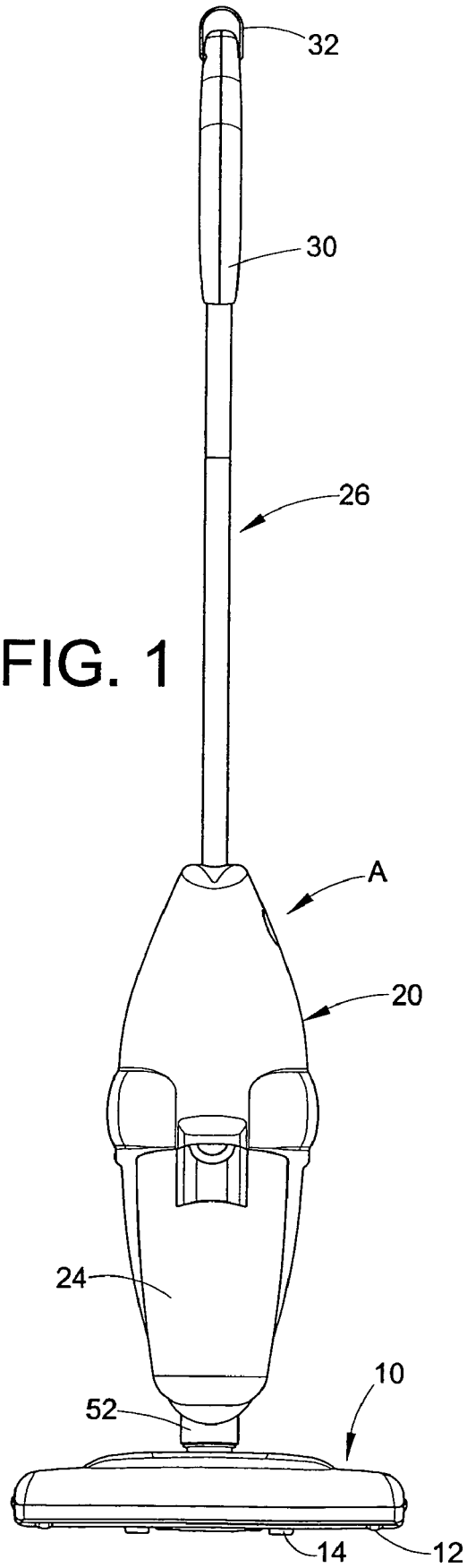
FIG. 1 is a front elevational view of a vacuum cleaner according to the present invention.
Figure 10:
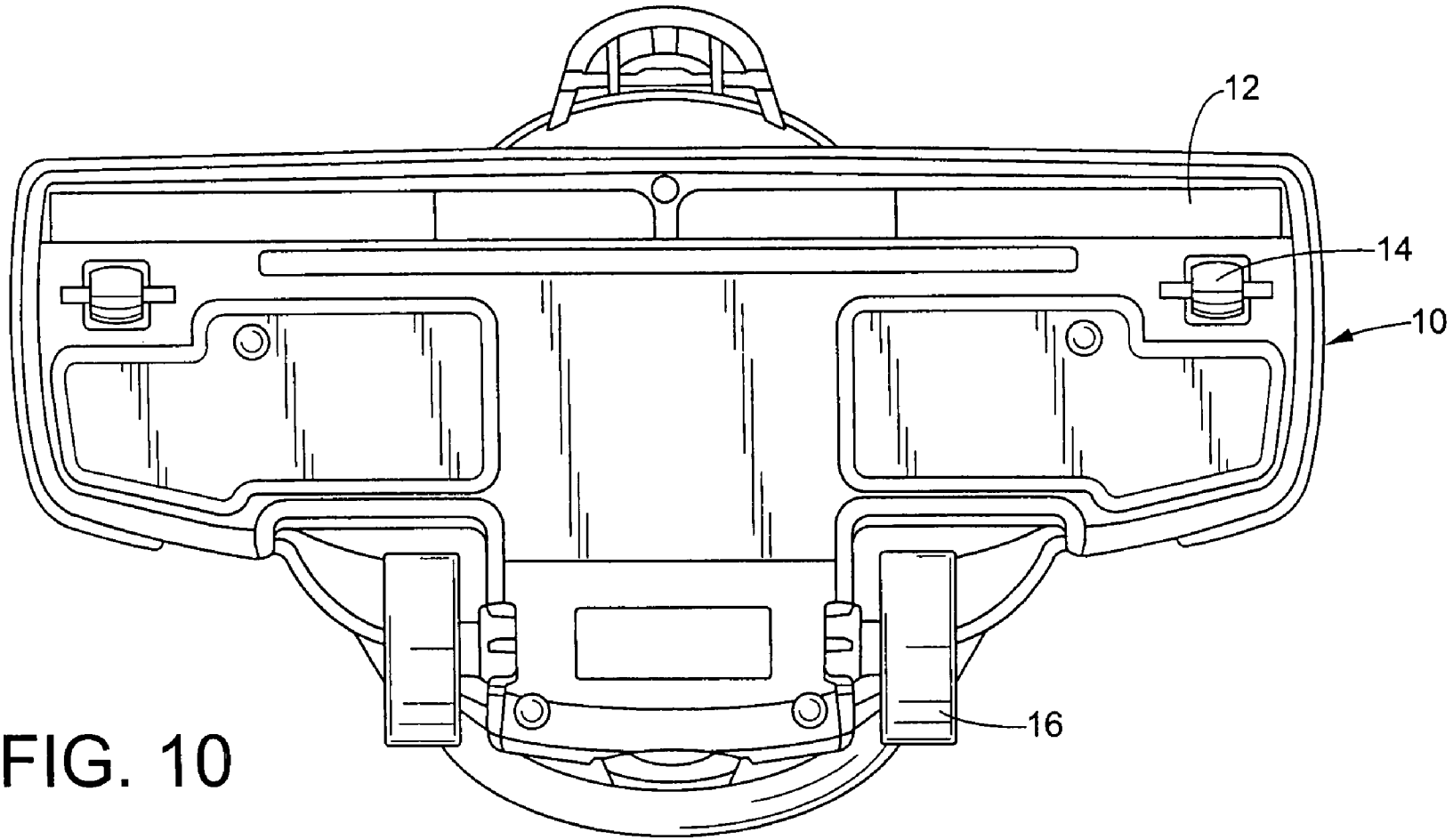
FIG. 10 is a bottom plan view of the vacuum cleaner of FIG. 1.

Referring now to the figures, wherein the showings are for purposes of illustrating several preferred embodiments of the invention only and not for purposes of limiting same, FIG. 1 illustrates a stick vac A including a nozzle base 10 having on an underside thereof a suction opening 12. As best shown in FIG. 10, also provided on the nozzle base are rollers 14, located immediately behind the suction opening, and rear wheels 16. With reference again to FIG. 1, supported on the nozzle base 10 is a housing 20. Defined in the housing is a socket 22 (FIG. 3) for selectively accommodating a dust cup 24. Extending from an upper end of the housing 20 is a handle 26. Positioned on a distal end of the handle is a hand grip 30 which supports a ring 32. The ring can be used to, for example, hang the stick vac from a suitable peg or hook mounted on a wall or in a closet or the like since the stick vac is a relatively light weight appliance.

Figure 2:
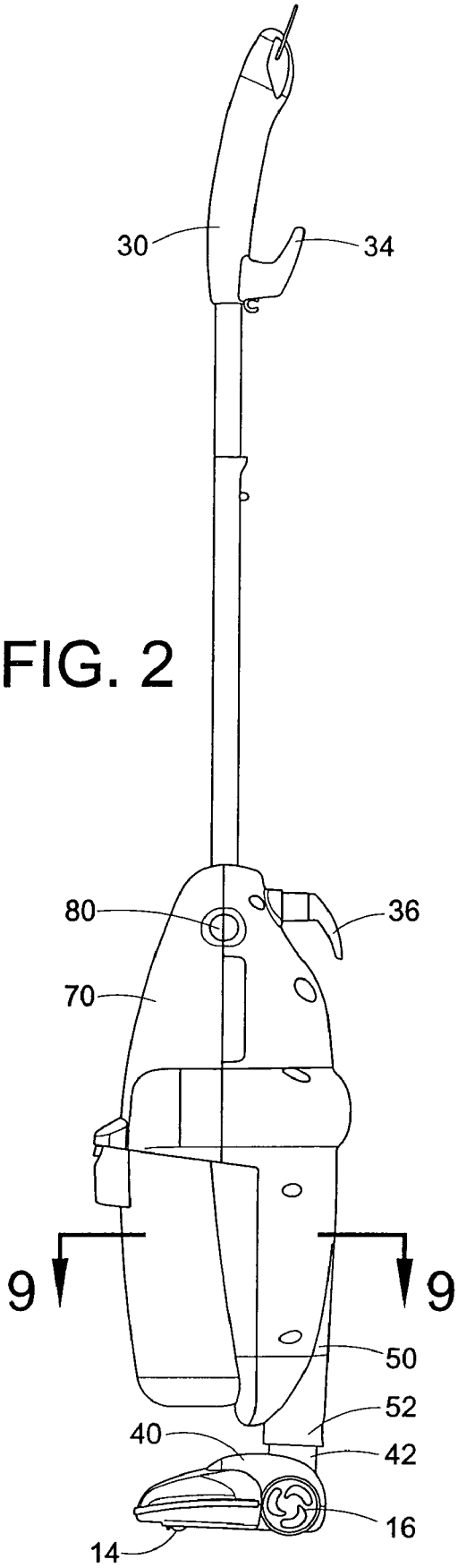
FIG. 2 is a side elevational view thereof.

With reference now to FIG. 2, also provided on the hand grip is a first cord hook 34. This cooperates with a second cord hook 36 located on the housing 20 in order to allow a conventional electrical cord (not illustrated) to be wrapped around the cord hooks when the appliance is not in use.

Figure 3:
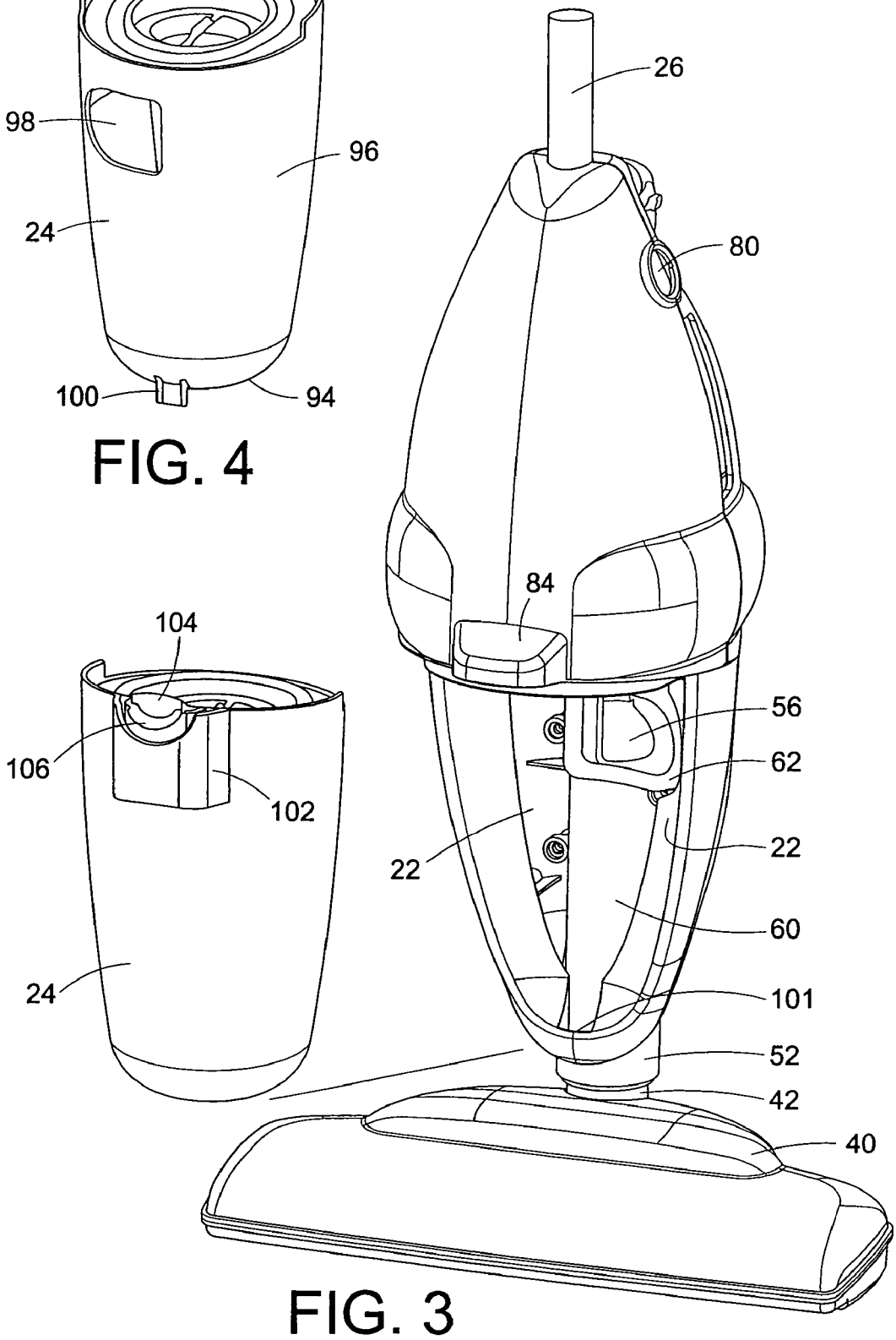
FIG. 3 is an enlarged exploded perspective view of a lower portion of the vacuum cleaner of FIG. 1.
Figure 8:
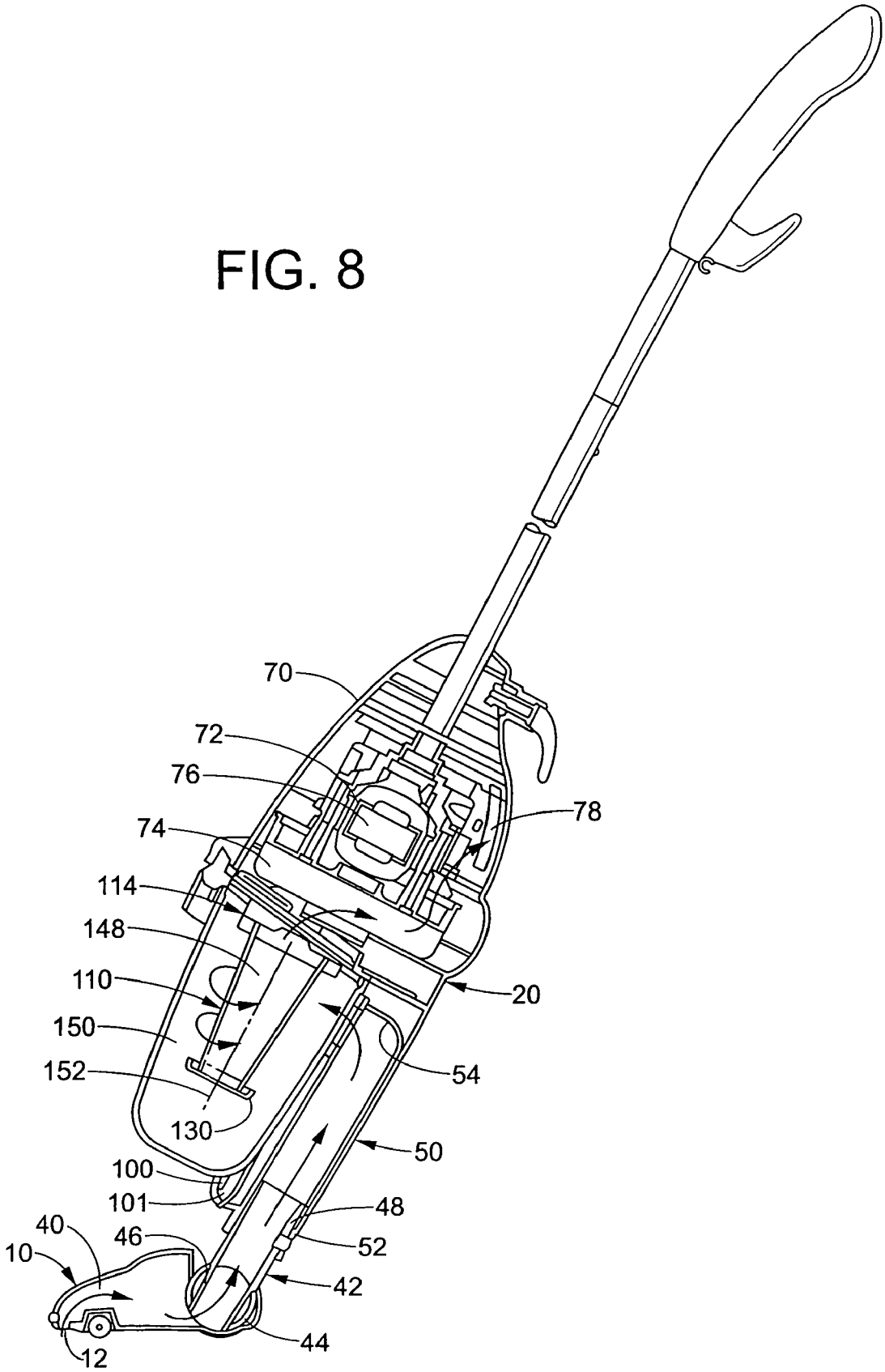
FIG. 8 is a cross sectional view of the vacuum cleaner of FIG. 2 with an upright housing thereof tilted back for use.

With reference now to FIG. 8, the nozzle base 10 includes a hollow interior 40 which allows air to flow from the suction opening 12 towards a first conduit 42. The first conduit includes a pivot area 44 at a first end 46 thereof. The first conduit extends out of the nozzle base 10 and terminates at a second end 48. The first conduit second end 48 is received in a second conduit 50 extending from the housing 20. To this end, the second conduit 50 has a first end 52 which slips over the fist conduit second end 48. The two conduits are secured together by conventional means. The second conduit extends along a portion of the housing 20 and terminates at a curved second end 54 which, as is best illustrated in FIG. 3, leads to an opening 56.

Figure 9:
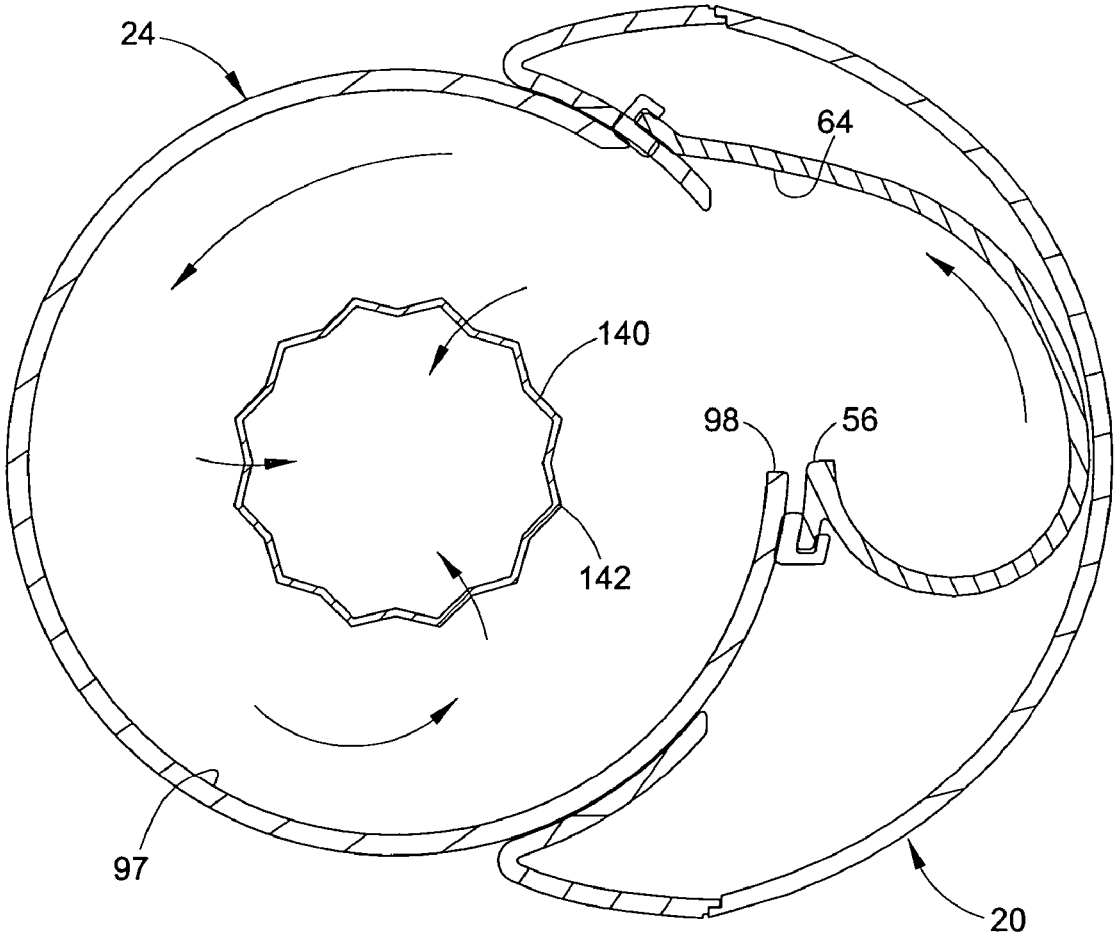
FIG. 9 is a cross sectional view through the vacuum cleaner of FIG. 2 along lines 9-9.

The opening 56 is located on an interior wall 60 of the housing 20 and is surrounded by an elastomeric gasket 62. As best seen in FIG. 9, a tangential, swirling, flow path 64 is thus provided for air entrained dirt which flows from the suction opening 12 through the first and second conduits 42 and 50 and out the opening 56.

An upper section 70 of the housing accommodates a motor/fan assembly 72. This includes a fan 74 and a motor 76 positioned above the fan. Exhaust air from the fan flows out through exhaust vents 78 provided in the housing 20. With reference again to FIG. 2, an on/off switch 80 is located on the housing upper section 70. Also defined on the housing upper section is a catch 84 as best illustrated in FIG. 3.

Figure 4:
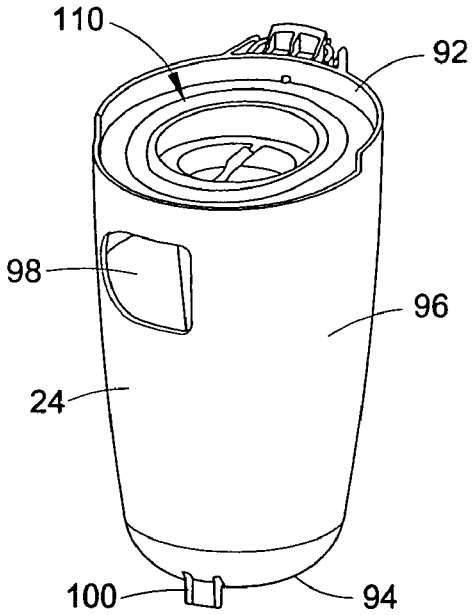
FIG. 4 is a rear perspective view of a dust cup of the vacuum cleaner of FIG. 3.

With reference now to FIG. 4, the dust cup 24 includes an open first end 92 and a closed second end 94 as well as a side wall 96 extending between the two ends and an interior wall 97. An opening 98 is defined in the side wall 96. Extending from the second end 94 of the dust cup is a stub 100. As best illustrated in FIG. 8, the stub 100 protrudes into a pocket 101 defined in the housing 20 in order to allow the dust cup 24 to be pivotally mounted on the housing. In other words, the stub 100 and pocket 101 define a hinge assembly for the dust cup on the housing.

Figure 5:
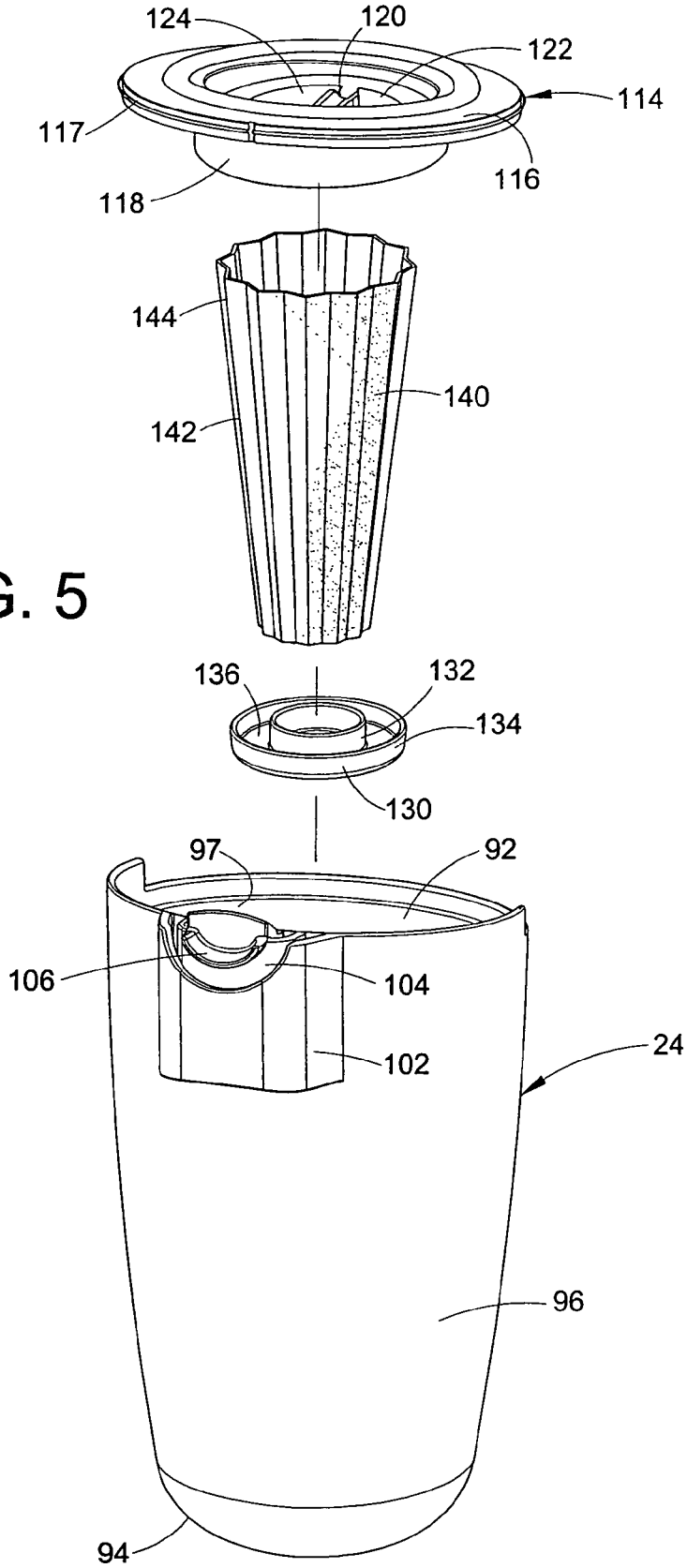
FIG. 5 is an exploded perspective view of the dust cup of FIG. 3 from above.
Figure 6:
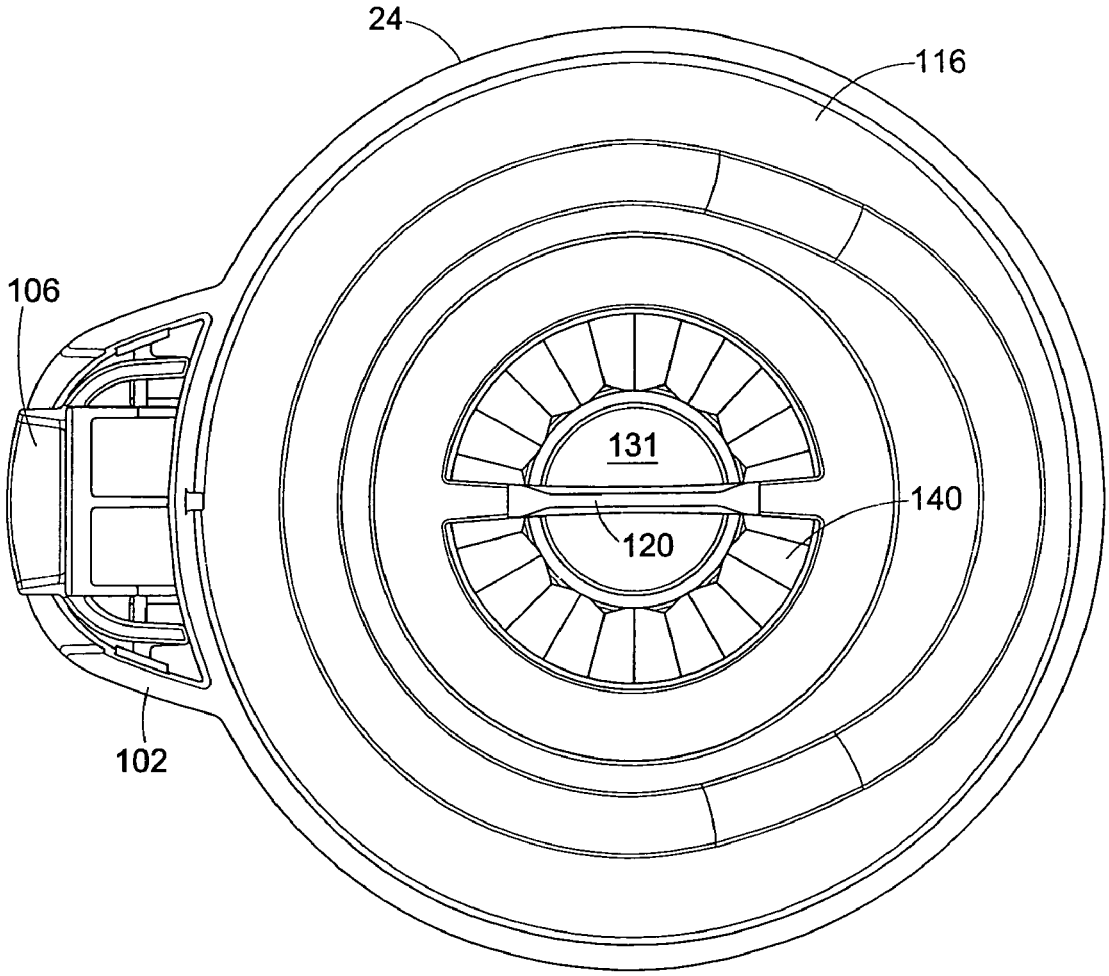
FIG. 6 is a top plan view of the dust cup of FIG. 5.

With reference now to FIG. 5, a handle 102 is defined on the side wall 96 of the dust cup adjacent the first end 92 thereof. The handle accommodates a moveable, resilient, latch 104 having a finger grip 106. As best illustrated in FIG. 8, when a downward force is exerted on the latch 104 at the finger grip 106, the latch releases from the catch section 84 on the housing thereby enabling the dust cup upper end to be pulled away from the housing. During this time, the dust cup pivots on the housing via a cooperation of the stub 100 in pocket 101 to provide a hinge function.

Figure 7:
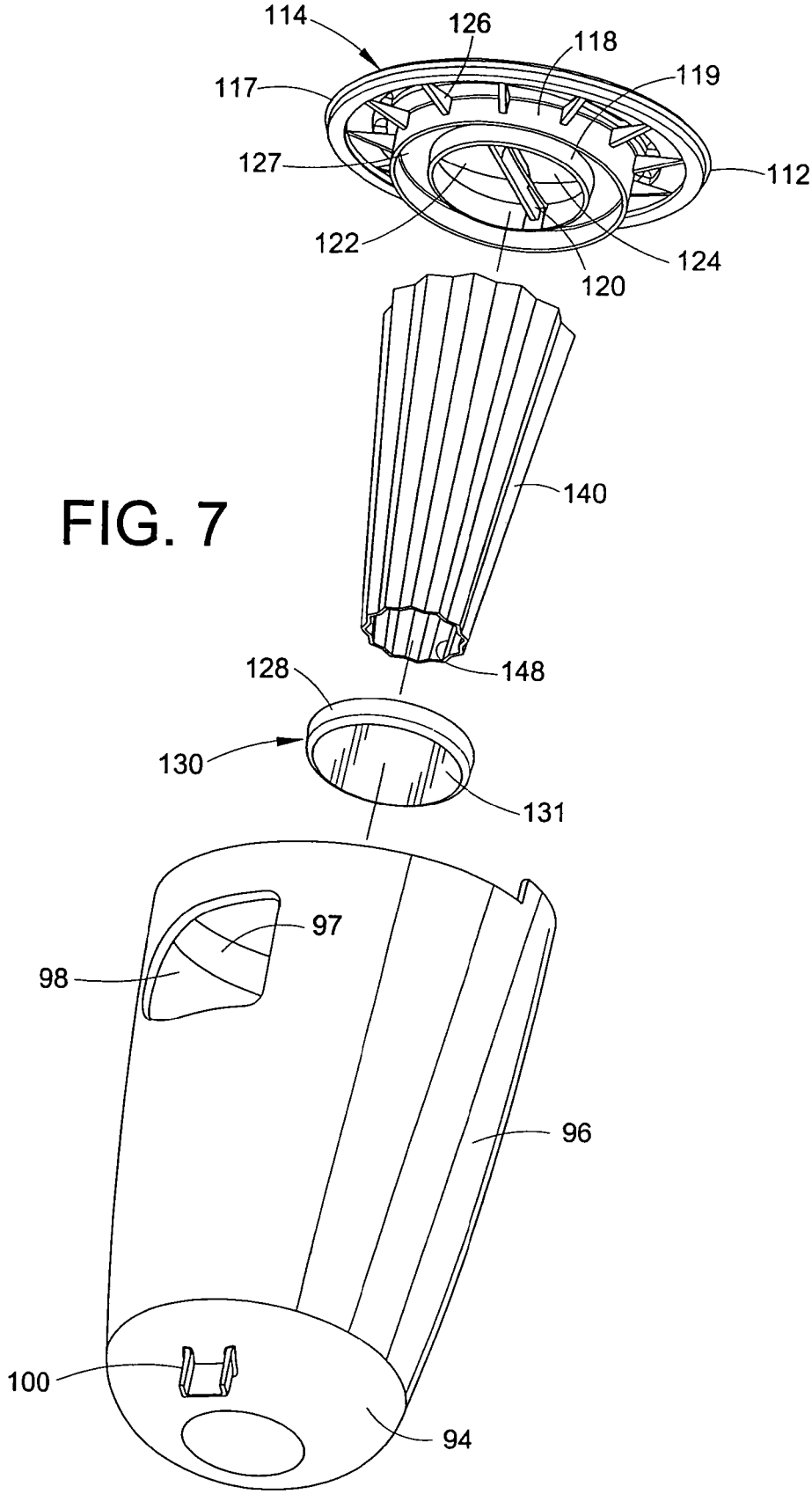
FIG. 7 is an exploded perspective view of the dust cup of FIG. 3 from below.

Selectively positioned in the dust cup 24 is a filter assembly 110. With reference now to FIG. 7, the filter assembly includes a first end 112 which is defined by a frame 114. The frame has a top wall 116 (FIG. 5) with a rim 117 and an outer skirt 118 depending therefrom. Spaced from the outer skirt is an inner skirt 119. Defined in the top wall 116 is a handle 120 which is in the form of a bridge extending between a pair of apertures 122 and 124 in the top wall. Reenforcing the top wall are a plurality of spaced ribs 126 which extend from the outer skirt 118 to the rim 117. A channel 127 is defined between the inner and outer skirts 119, 118. The filter assembly 110 also has a second end 128 which is defined by an end cap 130 having a bottom wall 131. With reference again to FIG. 5, extending from the bottom wall is an inner rim 132 and a skirt 134 defining an annular channel 136 therebetween. A filter 140 extends between the frame 114 and the end cap 130. The filter can be made of a planar filter medium which can be pleated as at 142. The filter has a first end 144 which is secured in the channel 127 of the frame 114 and a second end 146 which is secured in the channel 136 defined in the end cap 130, as may best be seen in FIG. 8.

The filter assembly 110 is frustoconical or tapered in its construction. Moreover, the filter material or medium 140 is also tapered in its shape as can be best seen in FIGS. 5 and 7. It is believed that the conical shape of the filter improves filtering efficiency, as compared with a right cylindrical shaped filter. This may be due, at least in part, to the increased efficiency of cyclonic airflow around the filter that is provided in the dust cup by the cooperation of the dust cup inner wall 97 and the filter. As is evident from FIG. 8, an approximately constant distance is defined between the filter and the inner wall of the dust cup so as to enhance the cyclonic flow of air around the filter and, hence, dirt separation. The conical filter shape also allows for an easier emptying of the dust cup 24 and may reduce the rate at which the filter 140 becomes clogged.

As is evident from FIG. 8, at the second or smaller diameter end 128 of the filter assembly, the end cap 130 is secured to the filter element 140. Similarly, at the first or larger diameter end 112 of the filter assembly, the frame 114 is secured to the filter element 140. The frame 114 includes the pair of apertures 122 and 124 which communicate with an interior 148 of the filter. With this construction, air must enter through the wall of the filter material 140 into the interior space 148. In other words, the frame 114 and the bottom wall 130 prevent airflow from entering the interior 148 of the filter without passing through the filter medium 140.

The generally conically shaped filter assembly 110 is mounted in the dust cup 24 such that the frame 114 selectively engages the interior wall 99 of the dust cup via an interference fit between the rim 117 of the top wall and the dust cup interior wall 97. In this way, the filter assembly 110 is releasably, yet securely, retained in its operative position, even when the dust cup 24 is removed from the vacuum cleaner A. Once this is accomplished, the filter assembly 110 can be removed from the dust cup 24 simply by grasping the handle 120 and pulling upward. Thereafter, the dust cup can be inverted so as to remove the dirt and dust contained therein. Subsequently, the dust cup can be righted again, the filter assembly can be reinstalled and the dust cup returned to the housing 20. This is accomplished by placing the stub 100 in the pocket 101 and then pivoting the dust cup back into position until the latch 104 engages the catch 84. The latch will be depressed until a tip of the latch clears the backside of the catch and then resiliently snaps upward to hold the dust cup in position, as illustrated in FIG. 8.

The filter material or medium can be made from a suitable conventional planar thermoplastic material if so desired, so that the filter can be washed. Alternatively, the filter medium can be made from a suitable paper material. The frame 114 and end cap 130 can be made from a suitable conventional thermoplastic material. The filter 140 can be secured to the frame 114 and end cap 130 by conventional means, such as adhesive, sonic welding or the like.

In use, as best shown in FIG. 8, air entrained dirt and dust enter the vacuum cleaner via suction opening 12. The air stream flows through the hollow interior 40 of the nozzle base 10 and into the first end 46 of the first conduit 42. The air then flows through the first conduit and into the second conduit 50. Air flows out of the second conduit at its curved second end 54. The air is directed into a cyclonic swirling flow in the dust cup 24 via the curved second end 54 of the second conduit. The air impinges upon the filter assembly 110 and swirls around it.

Thus, a cyclonic airflow chamber 150 is defined in the dust cup between the filter assembly 110 and the interior wall 97 of the dust cup. Particles in the air stream, such as dirt, dust and the like are removed or separated from the suction airstream in the cyclonic airflow chamber. More specifically, the location and orientation of the inlet opening 56 and the generally cylindrical configuration of the cyclonic airflow chamber 150 causes the suction airstream to follow a swirling or cyclonic path within the chamber, as best shown in FIG. 9. Dirt and dust are flung outwardly by centrifugal force toward the interior wall 97 of the dust cup 90. The removed particulate matter such as dirt, dust and the like then falls, via gravity, toward the bottom of the dust cup 24. It is retained therein until the dust cup is emptied.

Air, however, flows radially inward toward an axis 152 of the dust cup and then upward around the bottom cap 130 and then radially inward through the filter medium 140 into the interior space 148 thereof. Air then flows upward again through the apertures 122 and 124 around the handle 120 and into the fan 74. The suction airstream then flows into the fan 74 and out of the housing 20 via the exhaust vents 78. Thus, a clean air-type vacuum cleaner is here disclosed.

As previously noted, the conical or tapered shape of the filter assembly 110 enhances the removal effect of the cyclonic airflow path. Residual particulate matter, i.e., that which is not removed from the suction airstream as a result of the cyclonic action, normally lighter, smaller particles, are filtered by the filter element or medium 140 as the airflow path passes therethrough. The filter assembly 110 extends along the axis 152 of the dust cup such that the filter assembly is centrally positioned in the dust cup. Also, the axis 152 passes through the handle 120, as may be evident from FIG. 8. Thus, the filter assembly 110 is concentrically disposed in the dust cup 24.

The location and orientation of the opening 56 in the housing and the opening 98 in the dust cup will effect the direction of cyclonic airflow. However, it is contemplated that the openings could be located and arranged differently. For example, the direction of cyclonic airflow could be reversed. Thus, the cyclonic airflow direction could be clockwise or counter clockwise depending upon the location and arrangement of the aligned openings 56 and 98. Also, the location of the dust cup side wall opening 98 could be changed if desired. All such orientations and arrangements are considered within the scope of the present invention.

Moreover, those skilled in the art will recognize that the term cyclonic as used herein is not meant to be limited to a particular direction of airflow rotation. Rather, the cyclonic action discussed in the present invention is merely intended to separate a substantial portion of the entrained dirt and dust from the suction airstream and cause such dirt and dust to be deposited in the dust cup 24. The suction airstream then passes through the filter element or medium 140, so that residual contaminants are removed, and exits the cyclonic airflow chamber, as well as the dust cup, through the two openings 122 and 124 in the frame 114.

Figure 11:
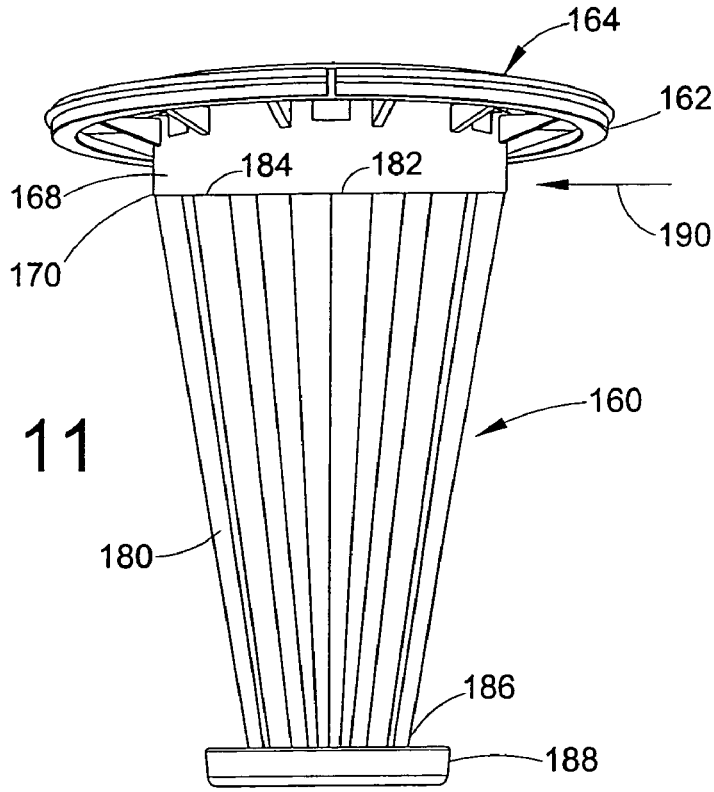
FIG. 11 is a schematic view of a filter according to another embodiment of the present invention; and, FIG. 12 is a schematic view of a filter according to a third embodiment of the present invention.

One potential disadvantage of the design illustrated in FIG. 8 is that the same portion of the filter medium 140 is exposed to the airstream entering the dust cup 24. Over time, the dust particles in the airstream may wear the filter material due to prolonged use of the vacuum cleaner. With reference now to FIG. 11, one way of addressing this issue is to lengthen the skirt of the frame so that the airflow hits the skirt and not the filter medium. More particularly, FIG. 11 illustrates a filter assembly 160 having a first end 162 which is provided with a frame 164. Extending away from the frame is a skirt 168. The skirt has a lower end 170. A filter medium 180 includes an upper end 182 which is in contact with and secured to the skirt lower end 170 along a securement line 184. The filter medium also has a lower end 186 which is covered by a bottom cap 188.

In the design illustrated in FIG. 11, the airflow, as depicted by arrow 190, entering the dust cup (not shown) contacts the thermoplastic material of the skirt 168 and swirls around the skirt rather than directly contacting the filter medium 180. The material of the frame 164 is less prone to wear than is the material of the filter medium 180. While FIG. 11 illustrates a design in which the filter is protected from the incoming airstream, a disadvantage of the design illustrated in FIG. 11 is that the filter itself is somewhat shorter, hence, affording less filtration area.

Figure 12:
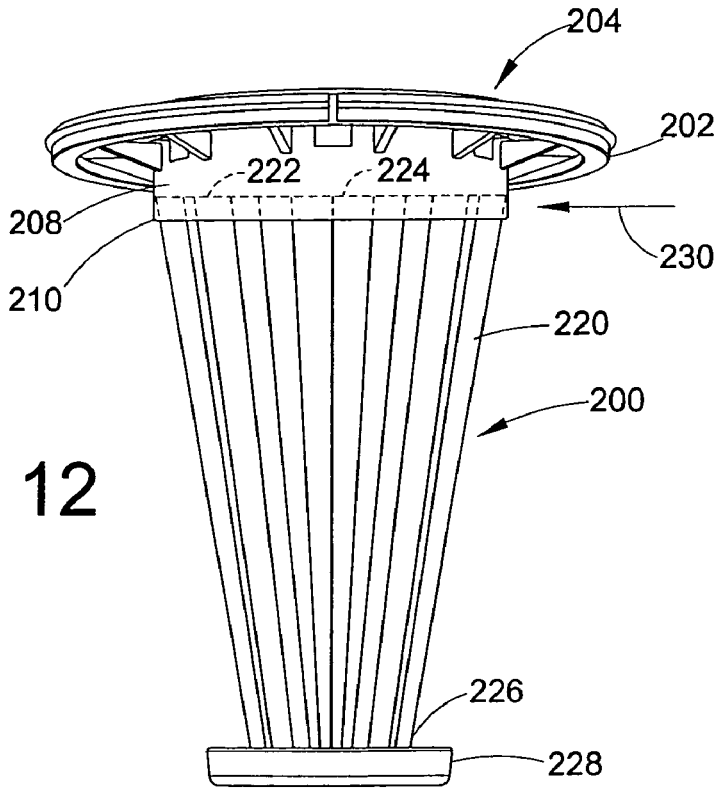

With reference now to FIG. 12, another design is there illustrated. In this design, a filter assembly 200 includes a first end 202 having a frame 204. Extending from the frame is a skirt 208. The skirt has a lower end 210. A filter medium 220 extends away from the frame 204. The filter medium has an upper end 222 which is secured via a securement line 224 to an inside periphery of the skirt. The filter medium also has a lower end 226 which is covered by a bottom cap 228. With the design illustrated in FIG. 12, the airflow, depicted by arrow 230, contacts the skirt 208, but yet the length of the filter medium 220 is not shortened. This is accomplished by extending the filter medium upwardly into the skirt until the upper end 222 of the filter is fastened to the skirt via the securement line 224.

The invention has been described with reference to several embodiments. Obviously, modifications and alterations will occur to others upon reading and understanding the preceding specification. It is intended that the invention be construed as including all such modifications and alterations insofar as they come within the scope of the appended claims, or the equivalents thereof.

The invention claimed is:

1. A vacuum cleaner filter, comprising:

a first end wall which blocks airflow axially through the filter;

a side wall which comprises a filter medium;

a second end wall, comprising:

an aperture which allows airflow therethrough, and a handle extending across said aperture from a first side wall thereof to an opposed second side wall thereof.

2. The filter of claim 1 wherein said handle is located in a plane of said second end wall.

3. The filter of claim 1 wherein said handle divides said aperture into two airflow openings.

4. The filter of claim 1 wherein said filter medium comprises a pleated planar material.

5. The filter of claim 1 wherein said filter side wall is generally conically shaped.

6. The filter of claim 1 wherein said side wall is permanently mounted to said first and second end walls to form an integral structure.

7. A filter which is selectively mounted to a dirt cup of a vacuum cleaner, the filter comprising:

a planar first end wall which blocks airflow therethrough;

a side wall which comprises a filter medium;

a second end wall comprising:

a top wall, an aperture defined in said top wall, which allows airflow therethrough, a skirt encircling said aperture, wherein an upper end of said side wall of said filter is secured to said skirt, wherein said second end wall is larger in diameter than said first end wall and is adapted to engage an internal peripheral side wall of an associated dirt cup, which side wall extends from a bottom wall of said dirt cup, via an interference fit between said second end wall and an upper edge of said internal peripheral side wall of said dirt cup.

8. The filter of claim 7 wherein said filter medium comprises a pleated planar material.

9. The filter of claim 7 wherein said side wall is generally conically shaped.

10. The filter of claim 7 wherein said second end wall further comprises a rim, said rim cooperating with the internal peripheral side wall of the associated dirt cup to selectively mount said filter to the associated dirt cup.

11. The filter of claim 7 wherein said second end wall further comprises a handle.

12. The filter of claim 11 wherein said handle extends across said aperture.

13. The filter of claim 12 wherein said filter is so oriented, when in use, in relation to an associated dirt cup that said second end wall is located above said first end wall.

14. A filter which is selectively mounted to a dust cup of a vacuum cleaner comprising:

an end cap including a first channel;

a side wall which comprises a filter medium, wherein a first end of said side wall is secured in said first channel;

a frame including a second channel, wherein a second end of said side wall is secured in said second channel;

an aperture defined in said frame for allowing airflow therethrough; and, a rim, said rim including an outer peripheral edge for cooperating with an upper portion of an inner surface of a side wall of an associated dirt cup to selectively mount said filter to the associated dirt cup.

15. The filter of claim 14 wherein said end cap blocks airflow therethrough.

16. The filter of claim 15 wherein said end cap has a diameter which is larger than a diameter of said first end of said side wall.

17. The filter of claim 14 wherein said filter medium comprises a pleated planar material.

18. The filter of claim 14 wherein said side wall is generally conically shaped.

19. The filter of claim 14 wherein said second channel is defined between an inner skirt and an outer skirt extending from a top wall of said frame.

20. The filter of claim 14 wherein said side wall has a length which is greater than a diameter of said end cap.

21. The filter of claim 14 wherein said frame further comprises a handle.

22. The filter of claim 21 wherein said handle extends across said aperture.

* * * * *